United States Patent [19]

Schmid

[11] Patent Number: 4,545,498

[45] Date of Patent: Oct. 8, 1985

[54] CONTAINER WITH LID FOR EFFERVESCENT PRODUCTS

[75] Inventor: Harry Schmid, Wil, Switzerland

[73] Assignee: Asepta AG Wil/SG, Wil, Switzerland

[21] Appl. No.: 597,057

[22] Filed: Apr. 5, 1984

[30] Foreign Application Priority Data

Apr. 8, 1983 [CH] Switzerland ..... 1919/83

[51] Int. Cl.[4] ..... B65D 51/16

[52] U.S. Cl. ..... 215/260; 220/373; 220/374; 215/261

[58] Field of Search ..... 215/10, 260, 261; 220/209, 367, 368, 369, 373, 374

[56] References Cited

U.S. PATENT DOCUMENTS 1,509,969 9/1924 Martin ..... 220/374 X 3,059,799 10/1962 Wilcox ..... 215/260

FOREIGN PATENT DOCUMENTS 159385 6/1957 Sweden ..... 220/373

*Primary Examiner*—Donald F. Norton

*Attorney, Agent, or Firm*—Browdy and Neimark

[57] ABSTRACT

A container for effervescent products, especially kefir, is covered by a lid having openings for the escape of the gas. A layer, covering the opening, is affixed to the surface of the lid. A passage leading to the exterior and connected with the opening is disposed between this layer and the lid. By means of this arrangement, the gas can escape from the container without difficulty, but germs and dust cannot enter the container from the top since the opening is covered.

7 Claims, 7 Drawing Figures

CONTAINER WITH LID FOR EFFERVESCENT PRODUCTS

FIELD OF THE INVENTION

The invention relates to a container for effervescent products having a lid with at least one opening to permit the escape of the gas.

BACKGROUND OF THE INVENTION

For the sealing of kefir containers the use of printed aluminum foil, the edges of which are crimped and sealed around the opening of the container, is known. Since kefir is effervescent the seal should not be completely tight, since in that case pressure can build up in the container, thereby lifting the foil or destroying it. For this reason the foil is perforated with needles after filling, so that the gas can escape.

This method, however, has not proved to be practical, since spore-carrying dust and germs can enter the container and spoil the contents. It is well known that milk products are very susceptible to infection and that even the smallest amounts of dirt can lead to the formation of mold.

Moreover, the perforated openings in the aluminum foil often are blocked by the milk serum, so that pressure which builds up in the container cannot be relieved. Because of the vibration during the automatic filling of the containers on a conveyor, splashes which adhere to the underside of the lid cause the openings to be covered by plugs formed when the sugar-containing milk serum thickens.

SUMMARY OF THE INVENTION

It is therefore one object of the present invention to provide a container with a lid of the above-mentioned type for effervescent products, especially for kefir and kefir-containing products, which avoids these disadvantages. In accordance with the present invention, this object is attained by means of a container having a lid with openings, a layer in the lid covering the openings and a passage between the lid and the layer, the latter being connected with the openings and leading laterally to the outside. The gases escaping through the openings enter the passage and flow laterally to the outside. The openings are covered on top so that dirt cannot fall in the container.

Still another object of the present invention is to provide a mechanism for relief of pressure within the container. This object is attained by covering at least one opening with a flexible flap. If the gap between the edge of the opening and the flap is gummed up by the milk serum, the pressure of the gas causes the flap to be pushed upwards, thereby clearing the opening.

BRIEF DESCRIPTION OF THE DRAWINGS

Exemplary embodiments of the present invention are further described below with reference to the drawings, in which.

DESCRIPTION OF THE PREFERRED EMBODIMENTS

Figure 1:
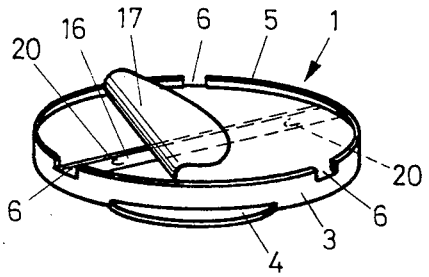
FIG. 1 is a perspective view of a plastic lid for a glass kefir container.
Figure 2:
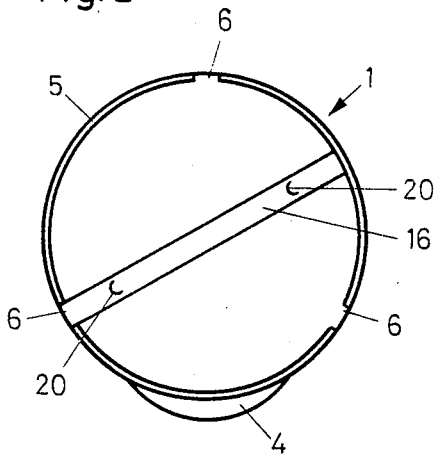
FIG. 2 is a top view of the lid of FIG. 1.

The lid 1 for a non-returnable kefir glass 2 shown in the drawings consists of a flexible, slightly elastic plastic material, as for example, polyethylenes like olefins, elastomers and soft PVC materials. Lids made from rubber are also possible.

Figure 4:
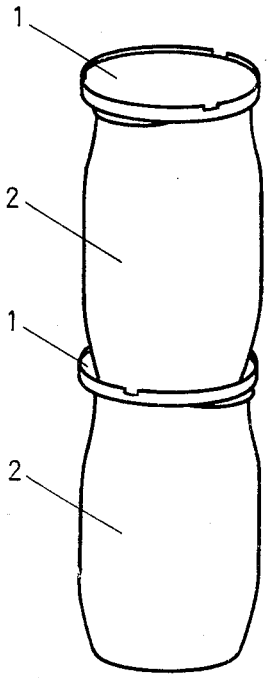
FIG. 4 shows two sealed kefir glasses, placed on top of each other.

The lid 1 has a turned-down edge 3 equipped with a side tab 4 and includes about its upper part a circumferential rim 5, which serves as a stacking support. Rim 5 is intended to provide lateral support for stacked glasses (FIG. 4). Slits 6 are provided in the rim 5, so that splashed water and other fluids can freely run off from the lid. The slits can be provided in any desired amount, length and shape.

Figure 3:
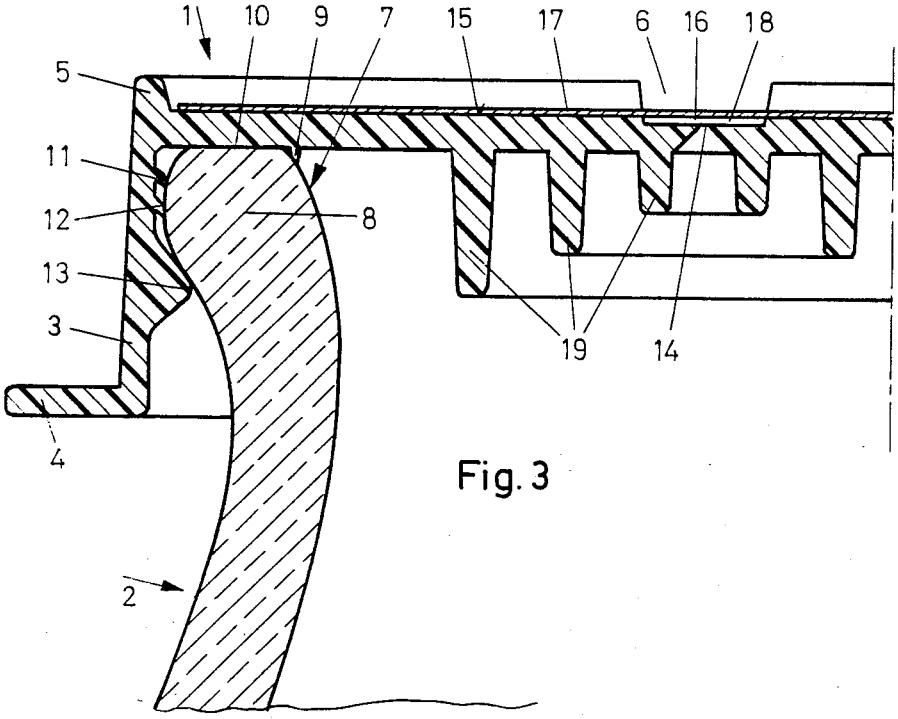
FIG. 3 is a cross section of the edge area of the lid in a larger scale.

As seen in FIG. 3, the mouth 7 of the glass container 2 has a thickened lip 8, which is elastically gripped by the lid edge 3. In the production of non-returnable glasses, which has to be done cost-effectively, relatively large differences in tolerances and unevenness of the glasses have to be taken into account. In order to achieve a positive seal, several sealing areas are provided.

A first circular sealing lip 9 is disposed under the lid and presses elastically against the uppermost annular surface 10 of the lip 8. This sealing lip 9 compensates for the unevenness at the mouth of the glass and forms a seal for the liquid, paste-like or gaseous contents of the container.

Next to the first sealing lip 9, but laterally disposed in the lid edge is a second sealing lip 11 which protrudes inwardly from the edge and compensates for the tolerances at the outwardly upper radius of the glass lip to form a second seal area.

A further sealing lip 12, disposed below the second sealing lip 11, also protrudes inwardly from the edge and compensates for the circumferential and diametrical tolerances of the glass lip, thereby forming a third seal area.

It would, of course, also be possible to provide sets of sealing rings for the several seal areas, instead of single sealing lips.

Finally, the lowest part of the lip edge 3 takes the form of a circular, inwardly protruding thickening, forming a clamping ring 13 which elastically grips the lip and, through prestressing, abuts tightly against it. The sealing lips and the lid assembly together with the clamping ring (which is continuous and has neither dogs nor notches) form a sealing system between the hollow glass and the plastic lid.

Since kefir and kefir-containing products are still effervescent after being filled in containers, i.e. they still emit $CO_2$, care has to be taken to provide for the escape of this gas from the container. At the same time the entry of germs which might spoil the contents has to be prevented.

In the embodiment according to FIG. 3, the lid 1 has in its center an opening 14 which tapers towards the outside and ends in a shallow channel 16 recessed in the lid surface 15, the end of which is connected with one of the slits 6.

Figure 6A:
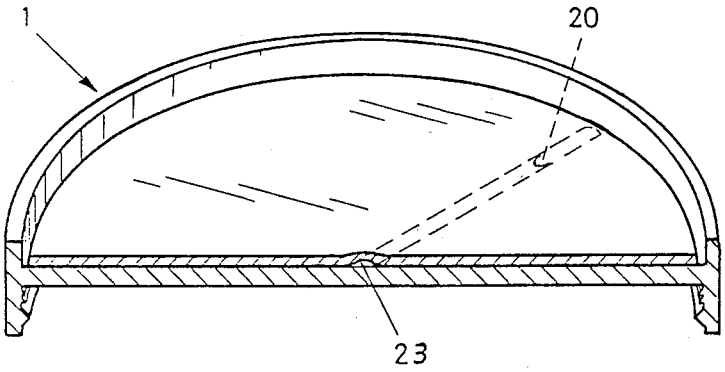
FIG. 6*a* is another embodiment of a lid according to the present invention.
Figure 6B:
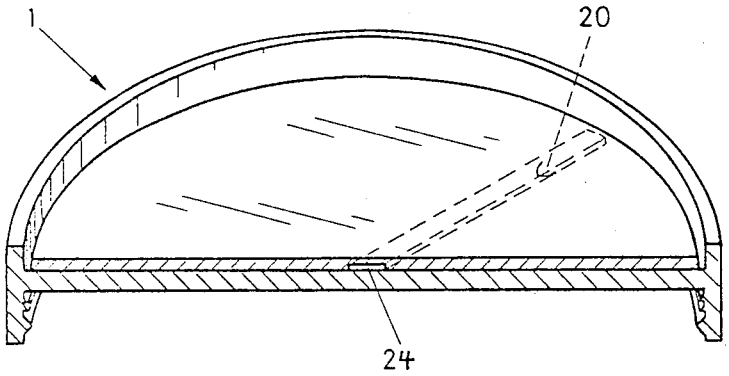
FIG. 6*b* is another embodiment of a lid similar to that shown in FIG. 6*a*.

A label 17, made from moisture-resistant paper, is attached on the lid 1 as for example by pasting it on, thereby forming a layer. Because of the channel 16, a small passage 18 is formed between the label 17 and the surface of the lid through which the gases can escape laterally to the outside. A covering layer such as that described above, could also consist of treated cardboard, plastic or a metal foil, rather than paper. It would also be possible to place the passage in the covering layer, instead of in the lid, by means of indentations (23 in FIG. 6*a*) and especially indentations made by stamping (24 in FIG. 6*b*). Since the opening is covered from above by the covering layer, no spore carriers can enter the container.

It has been shown to be practical to provide "splash barriers" 19 under the lid to prevent the gumming up of the openings. In the example shown, three sleeve-like edges 19 of differing diameter and differing size are provided coaxially to the opening 14. The liquid, slopping because of the shaking of the container—e.g. on the conveyor during the automatic filling—, is stopped by any one or all of the barriers and cannot reach the opening. After the cooling of the container the contents become viscous, and this puts an end to the problem.

Figure 5:
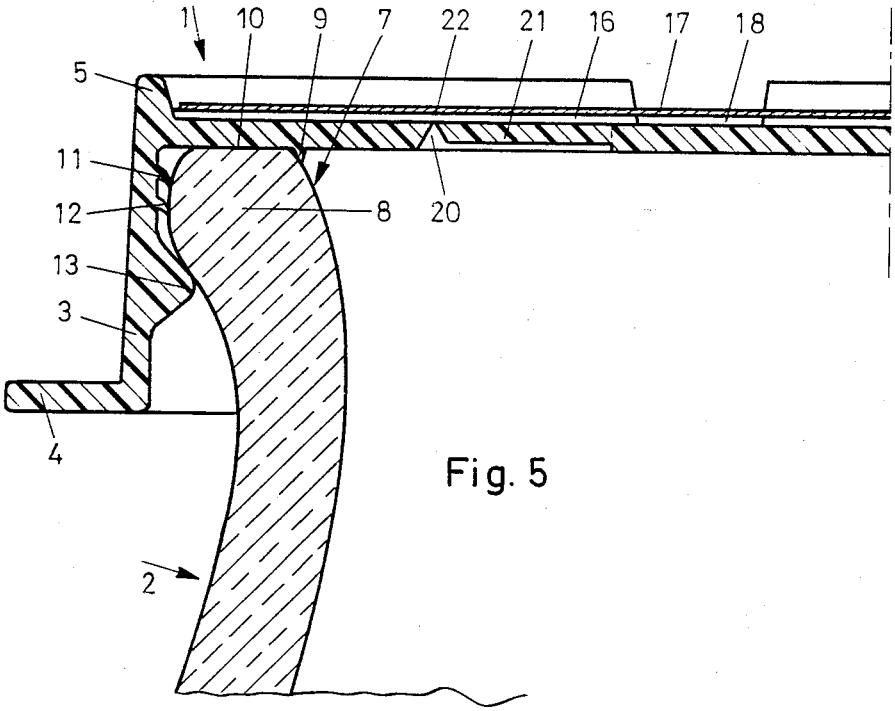
FIG. 5 is a further embodiment of a lid.

In another embodiment of the present invention in accordance with FIG. 5, two openings 20 are provided in the lid 1, which are each closed by means of a flexible closure flap 21. The closure flap 21, formed in one piece with the lid 1, forms a part of the bottom of the lid and its surface is disposed on the channel 16 into which the opening 20 lead. The connection of the flap with the bottom of the lid acts as a flexible hinge.

In this embodiment, too, a covering layer 17 is pasted to the lid, as a result of which gas can escape laterally through the passage 18. If, because of the semicircular slit 22 between the edge of the opening and the edge of the flap being gummed up, gas pressure increases in the container, the flap will bend upwardly and expose the opening 20 again. Here to, a splash barrier could be additionally provided.

What is claimed is:

1. A container for effervescent products with a lid having at least one opening to permit escape of the gas, comprising:

a layer disposed on the lid and covering said opening, and a passage disposed between said layer and said lid, said passage leading to the exterior and being connected with the opening, and said passage comprising at least one channel recessed in a surface of the lid, said at least one opening communicating with said channel.

2. A container for effervescent products with a lid having at least one opening to permit escape of the gas, comprising:

a layer disposed on the lid and covering said opening, and a passage disposed between said layer and said lid, said passage leading to the exterior and being connected with the opening, and said layer including indentations which form said passage.

3. A container in accordance with claim 2, wherein said indentations are made by stamping.

4. A container for effervescent products with a lid having at least one opening to permit escape of the gas, comprising:

a layer disposed on the lid and covering said opening, and a passage disposed between said layer and said lid, said passage leading to the exterior and being connected with the opening, wherein said opening is closed by means of a flexible flap.

5. A container for effervescent products with a lid having at least one opening to permit escape of the gas, comprising:

a layer disposed on the lid and covering said opening, and a passage disposed between said layer and said lid, said passage leading to the exterior and being connected with the opening, one rib being disposed under the lid, said rib protruding downwardly and surrounding said opening.

6. A container for effervescent products with a lid having at least one opening to permit escape of the gas, comprising:

a layer disposed on the lid and covering said opening, and a passage disposed between said layer and said lid, said passage leading to the exterior and being connected with the opening, a plurality of ribs being provided under said lid, said ribs being disposed at a distance from each other and being of differing sizes.

7. A container for effervescent products with a lid having at least one opening to permit escape of the gas, comprising:

a layer disposed on the lid and covering said opening, and a passage disposed between said layer and said lid, said passage leading to the exterior and being connected with the opening, said lid including rim serving as a stacking support, said rim having at least one slit, and said passage being connected with said slit.

* * * * *